US008915716B2

(12) United States Patent
Dunkel et al.

(10) Patent No.: US 8,915,716 B2
(45) Date of Patent: Dec. 23, 2014

(54) TURBOMACHINE ROTOR

(75) Inventors: Gabriel Dunkel, Birr (CH); Marco Micheli, Schoefflisdorf (CH); Wolfgang Kappis, Fislisbach (CH); Luis Federico Puerta, Rieden (CH)

(73) Assignee: Alstom Technology Ltd., Baden (CH)

( * ) Notice: Subject to any disclaimer, the term of this patent is extended or adjusted under 35 U.S.C. 154(b) by 519 days.

(21) Appl. No.: 13/433,314

(22) Filed: Mar. 29, 2012

(65) Prior Publication Data

US 2012/0251325 A1 Oct. 4, 2012

(30) Foreign Application Priority Data

Mar. 31, 2011 (CH) ..... 0583/11

(51) Int. Cl.
*F01D 5/30* (2006.01)
*F01D 5/14* (2006.01)
*F01D 11/00* (2006.01)

(52) U.S. Cl.
CPC ..... *F01D 5/143* (2013.01); *F01D 5/3038* (2013.01); *F01D 11/008* (2013.01)
USPC ..... 416/219 R; 416/220 R

(58) Field of Classification Search
USPC ..... 416/219 R, 197 R, 215, 220 R, 225, 217, 416/218
See application file for complete search history.

(56) References Cited

U.S. PATENT DOCUMENTS 2,669,383 A 2/1954 Purvis et al.
2,916,257 A * 12/1959 Poellmitz et al. ..... 416/220 R
3,008,689 A 11/1961 Morley et al.
4,878,811 A 11/1989 Jorgensen
5,232,346 A 8/1993 Mitchell et al.

(Continued)

FOREIGN PATENT DOCUMENTS

CN 1398322 A 2/2003
FR 996 967 A 12/1951

(Continued)

OTHER PUBLICATIONS

Office Action issued on May 6, 2014, by the Russian Patent Office in corresponding Russian Patent Application No. 2012112418, and an English Translation of the Office Action. (10 pages).

(Continued)

*Primary Examiner* — Edward Look
*Assistant Examiner* — Aaron R Eastman
(74) *Attorney, Agent, or Firm* — Buchanan Ingersoll & Rooney PC

(57) ABSTRACT

A rotor for a turbomachine includes at least one moving blade row including a plurality of moving blades disposed adjacent to one another in a circumferential direction with respect to an axis of rotation. Each one of the plurality of moving blades includes a blade leaf and a blade root having an outer face, the outer face of the blade root including a blade root curved end wall contour adjacent the blade leaf in the circumferential direction. The blade root curved end wall contour has a concave curvature in an axial sectional plane of the rotor. At least one rotor shaft includes a reception slot for a respective one of the at least one moving blade row extending in the circumferential direction. Each of the plurality of moving blades is inserted into the reception slot via a respective blade root.

11 Claims, 3 Drawing Sheets

(56) References Cited

U.S. PATENT DOCUMENTS

| | | | | |
|---|---|---|---|---|
| 5,397,215 | A * | 3/1995 | Spear et al. | 415/191 |
| 6,283,713 | B1 | 9/2001 | Harvey et al. | |
| 6,669,445 | B2 | 12/2003 | Staubach et al. | |
| 7,300,253 | B2 | 11/2007 | Beeck et al. | |
| 8,459,956 | B2 | 6/2013 | Pandey et al. | |
| 2003/0012654 | A1 | 1/2003 | Strassberger et al. | |
| 2003/0170124 | A1 | 9/2003 | Staubach et al. | |
| 2007/0020102 | A1 | 1/2007 | Beeck et al. | |
| 2009/0087316 | A1 | 4/2009 | Mueller | |
| 2010/0158696 | A1 | 6/2010 | Pandey et al. | |

FOREIGN PATENT DOCUMENTS

| | | | |
|---|---|---|---|
| JP | 2003-522872 | A | 7/2003 |
| JP | 2003-269384 | A | 9/2003 |
| JP | 2009-503330 | A | 1/2009 |
| JP | 2009-085224 | A | 4/2009 |
| WO | 2010/074930 | A1 | 7/2010 |

OTHER PUBLICATIONS

Office Action issued on Jul. 1, 2014, by the Chinese Patent Office in corresponding Chinese Patent Application No. 201210103914.1. (8 pages).

Office Action (Patent Examination Report No. 1) issued on Jul. 9, 2014, by the Australian Patent Office in corresponding Australian Patent Application No. 2012201556. (3 pages).

Office Action (Notification of Reasons for Refusal) issued on Aug. 25, 2014, by the Japan Patent Office in corresponding Japanese Patent Application No. 2012-076732, and an English Translation of the Office Action. (15 pages).

European Patent Office, Search Report in Swiss Patent Application No. 58 32 011 (Apr. 18, 2011).

* cited by examiner

TURBOMACHINE ROTOR

CROSS REFERENCE TO PRIOR APPLICATIONS

Priority is claimed to Swiss Application No. CH 00583/11, filed on Mar. 31, 2011, the entire disclosure of which is incorporated by reference herein.

FIELD

The present invention relates to a rotor for a turbomachine.

BACKGROUND

A rotor conventionally comprises at least one moving blade row having a plurality of moving blades which are arranged so as to be spaced apart from one another in the circumferential direction with respect to an axis of rotation of the rotor. In this case, the moving blades project from the rotor into a gas path. A working gas flows in this gas path when the turbomachine is in operation. Furthermore, such a rotor typically comprises a rotor shaft which has for the respective moving blade row a reception slot which extends in the circumferential direction and into which the moving blades are inserted with their blade roots. Furthermore, a plurality of intermediate pieces may be provided, which are arranged in the reception slot in each case between two adjacent moving blades.

Moreover, the moving blades have in each case a blade leaf which projects from the associated blade root, via which the respective moving blade is fastened to the rotor shaft, essentially radially away from the rotor and which thus protrudes into the gas path. In the region of an inner end portion assigned to the blade root, particularly in the case of a compressor, stabilization of the gas flow when the turbomachine is in operation can be achieved by means of special contouring on a rotor outer face adjacent to the blade leaf and exposed to the gas path. This contouring is a rotor end wall contour which delimits the gas path and which, in particular, may be curved along the gas path. In this case, it is basically possible to equip the moving blades at their blade roots, on an outer face confronting the gas path, with such a curved end wall contour next to the blade leaf in the circumferential direction.

For example, the drawings of U.S. Pat. No. 5,232,348 A and of U.S. Pat. No. 2,916,257 A show curved end wall contours, the gas path-side end walls of the intermediate pieces merging flush, and free of steps, into the end walls of the blade roots. Instead of the curvature having, confronting the gas path, a configuration which is convex, a rectilinear configuration may also be provided.

SUMMARY OF THE INVENTION

In an embodiment, the present invention provides a rotor for a turbomachine. The rotor includes at least one moving blade row including a plurality of moving blades disposed adjacent to one another in a circumferential direction with respect to a rotor axis of rotation. Each one of the plurality of moving blades includes a blade root having an outer face, the outer face of the blade root including a blade root curved end wall contour next to a blade leaf of the respective moving blade in the circumferential direction. The blade root curved end wall contour has a concave curvature in an axial sectional plane of the rotor. At least one rotor shaft includes a reception slot for a respective one of the at least one moving blade row extending in the circumferential direction. Each of the plurality of moving blades is inserted into the reception slot via a respective blade root. A plurality of intermediate pieces is each disposed in the reception slot between two adjacent ones of the plurality of moving blades. Each of the plurality of intermediate pieces includes an intermediate piece curved end wall contour on an outer face of the respective intermediate piece, the intermediate piece curved end wall contour having a concave curvature in an axial sectional plane of the rotor, wherein the outer faces of the blade roots and the intermediate pieces are adjacent to one another flush radially in the circumferential direction.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
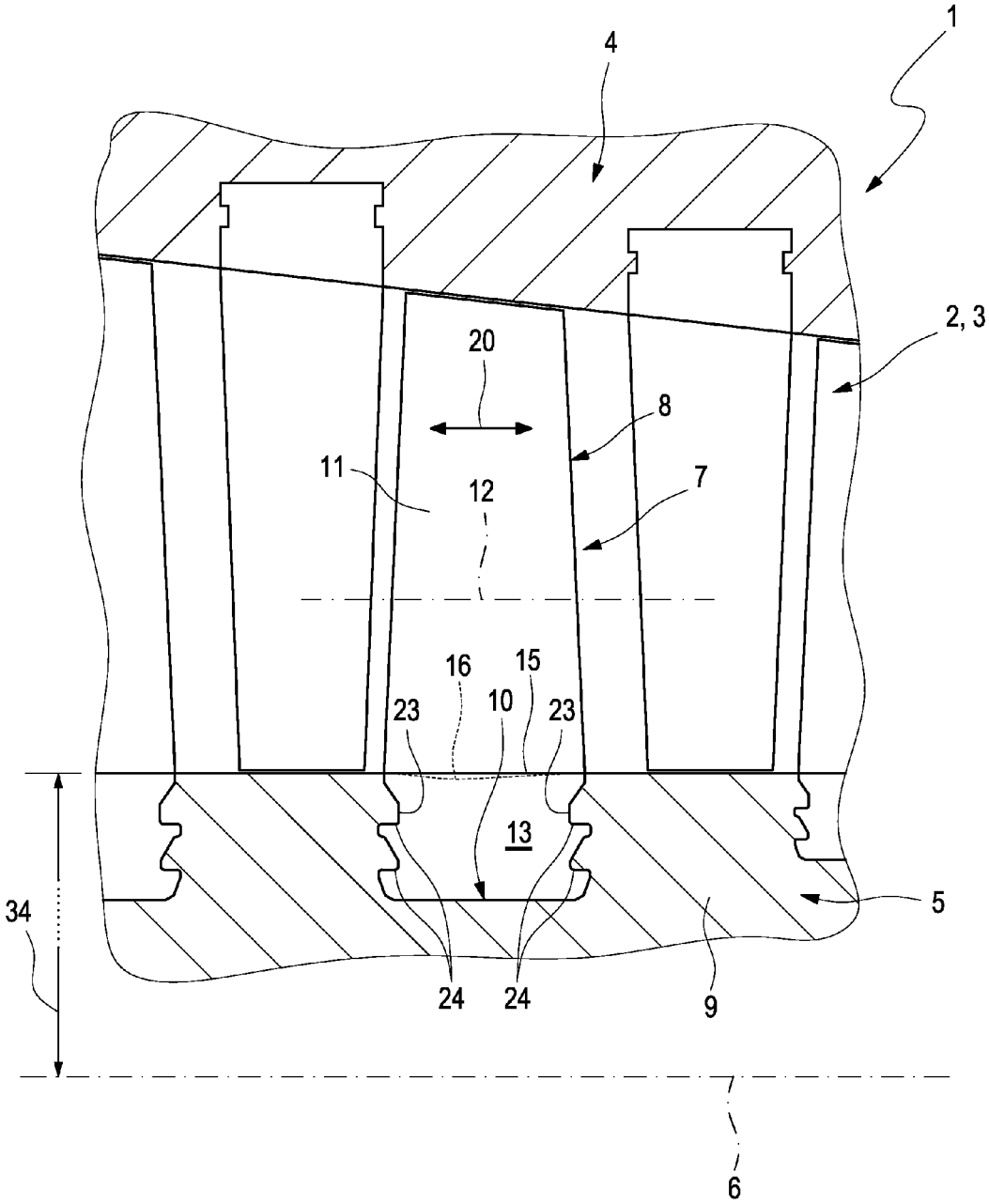
FIG. 1 shows a longitudinal section through a turbomachine in the region of a rotor.

In an embodiment the present invention relates to the problem of specifying for a rotor of the type initially mentioned an improved embodiment which, in particular, is distinguished in that the end wall contour can be produced more easily. At the same time, a comparatively cost-effective modernization of existing turbomachines is also to be made possible.

The respective end wall contour, according to an advantageous embodiment, may have in axial section exactly two turning points and, in particular, merge at its axial ends tangentially into the outer face of the rotor shaft. Additionally or alternatively, the respective end wall contour may be concavely curved. Additionally or alternatively, it is possible that, in the respective end wall contour, the curvature is arranged eccentrically along the gas path, while at the same time, particularly in the case of a compressor, it may be displaced toward the inflow side.

In an embodiment, a compressor according to the invention or a turbine according to the invention is equipped with a rotor of the type described above and can be used in a turbomachine, for example in a stationary turbomachine of a power plant.

In an embodiment of the invention, in particular, there is provision for equipping not only those outer faces of the blade roots which confront the gas path but also the outer face of the intermediate pieces which confronts the gas path with an end wall contour of this type. As a result, the transition from the end wall contour of the outer face of respective blade root to the end wall contour of the outer face of the respectively adjacent intermediate piece has a simpler configuration. There is therefore no longer any need, in particular, for a complex three-dimensional shaping for the end wall contour on the blade root. The outlay for producing the end wall contours can thus be reduced. Since then, according to the invention, the intermediate pieces are also provided with such an end wall contour, it is possible, for example for the purpose of modernization, to exchange the moving blades and intermediate pieces in order to equip an existing turbomachine with the curved end wall contour at a later date.

According to an advantageous embodiment, the end wall contours on the outer faces of the blade roots and of the intermediate pieces may be identical. Producing identical end wall contours both on the blade roots and on the intermediate pieces avoids complex three-dimensional transitions, thus simplifying the production of the end wall contours.

According to an especially advantageous embodiment, the end wall contours may have an axially symmetrical configuration. This means that the end wall contours have a rotationally symmetrical configuration with respect to the axis of rotation. In other words, the respective end wall contour is uniformly or constantly profiled in the circumferential direction in a sectional plane which contains the axis of rotation. It is consequently especially simple to apply the end wall contours to the outer faces of the blade roots and to the outer faces of the intermediate pieces.

According to another advantageous embodiment, the intermediate pieces and the blade roots may have an asymmetric configuration in the axial direction, in such a way that the intermediate pieces can be properly mounted only in a single mounting position. In the event that the curved end wall contours are configured asymmetrically in the axial direction, the form of construction proposed above avoids the faulty mounting of the intermediate pieces which would be considerably detrimental to the flow around the respective moving blades in the region of the blade root.

According to an embodiment, the reception slot may have radially inward-directed supporting contours on slot walls lying axially opposite one another, the intermediate pieces having radially outward-directed supporting contours which are complementary to the supporting contours of the reception slot and which, in the mounted state, are supported radially on the supporting contours of the reception slot. As a result, the intermediate pieces are fixed in the reception slot radially outward by means of an intensive form fit between the supporting contours bearing one against the other. So that the intermediate pieces can be introduced into the respective reception slot, the rotor shaft may be divided in an axial plane.

According to a preferred development, the blade roots may have on their inner face facing away from the gas path or facing away from their outer face shoulders which project in the circumferential direction and which, in the mounted state, are supported radially on an inner face, facing away from the respective outer face, of the respective adjacent intermediate piece. In this embodiment, therefore, the blade roots are secured radially to the rotor shaft indirectly via the intermediate pieces. Additionally, the blade roots, as well as the intermediate pieces, may have supporting contours which cooperate with the supporting contours of the reception slot.

In a preferred embodiment, the moving blades are fastened radially to the rotor shaft solely indirectly via the intermediate pieces. It is thereby possible in an especially simple way to draw the moving blades radially out of the reception slot in the event of maintenance, if, for this purpose, at least one intermediate piece is taken out of the reception slot, so that all the other intermediate pieces and blade roots can be displaced in the circumferential direction within the reception slot.

Further important features and advantages of the invention may be gathered from the subclaims, from the drawings and from the accompanying figure description relating to the drawings.

According to FIG. 1, a turbomachine 1, which may be a gas turbine plant or a steam turbine plant of a power station for current generation, comprises a compressor 2 or a turbine 3 with a stator 4 in which a rotor 5 is mounted rotatably about an axis of rotation 6. The rotor 5 has at least one moving blade row 7 possessing a plurality of moving blades 8 which are arranged adjacently to one another in the circumferential direction with respect to the axis of rotation 6. The dashed and dotted line illustrated in FIG. 1 and representing the axis of rotation 6 is not to be understood as being true to scale, but merely for indicating the orientation of this axis of rotation 6.

The rotor 5 has, furthermore, a rotor shaft 9, into which a reception slot 10 extending in ring form in the circumferential direction is incorporated for the respective moving blade row 7. The moving blades 8 possess in each case a blade leaf 11, which in the installed state protrudes into a gas path 12 indicated in FIG. 1 by a dashed and dotted line, and a blade root 13 which is inserted into the reception slot 10. The blade root 13 is to that extent integrated structurally into the rotor shaft 9. Furthermore, the rotor 5 according to FIG. 2 comprises a plurality of intermediate pieces 14 which are likewise inserted into the reception slot 10 and here are arranged in each case between two adjacent moving blades 8 or between two adjacent blade roots 13. Intermediate pieces 14 and moving blades 8 or blade roots 13 thus alternate within the respective moving blade row 7 or within the associated reception slot 10.

Figure 5:
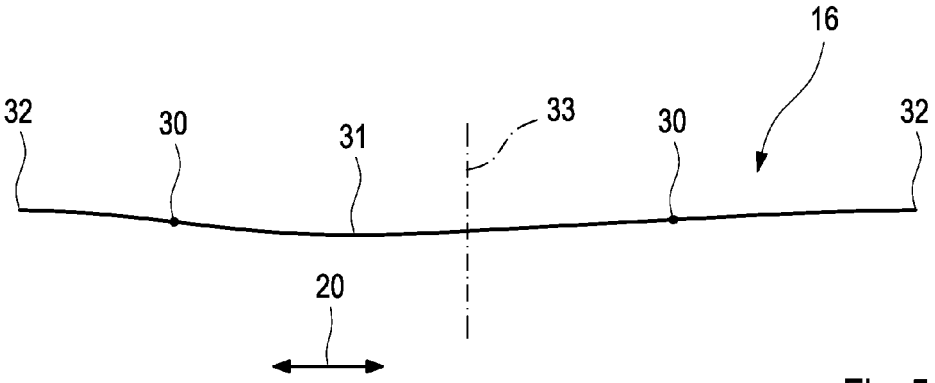
FIG. 5 shows an end wall contour in longitudinal section.

The respective blade root 13 has, on its outer face 15 confronting the gas path 12 and located next to the blade leaf 8 in the circumferential direction, a curved end wall contour 16 which is indicated in FIG. 1 and is reproduced in FIG. 5. The intermediate pieces 14 likewise possess an outer face 17 which confronts the gas path 12 and on which the intermediate pieces 14 likewise have in each case a curved end wall contour 16 of this type. The curvature of the end wall contour 16 in this case extends along the gas path 12, that is to say essentially along the axial direction which is defined by the axis of rotation 6. Furthermore, at least the intermediate pieces 14 may also be curved in the circumferential direction, to be precise according to a radius 34 of the rotor 5.

Figure 2:
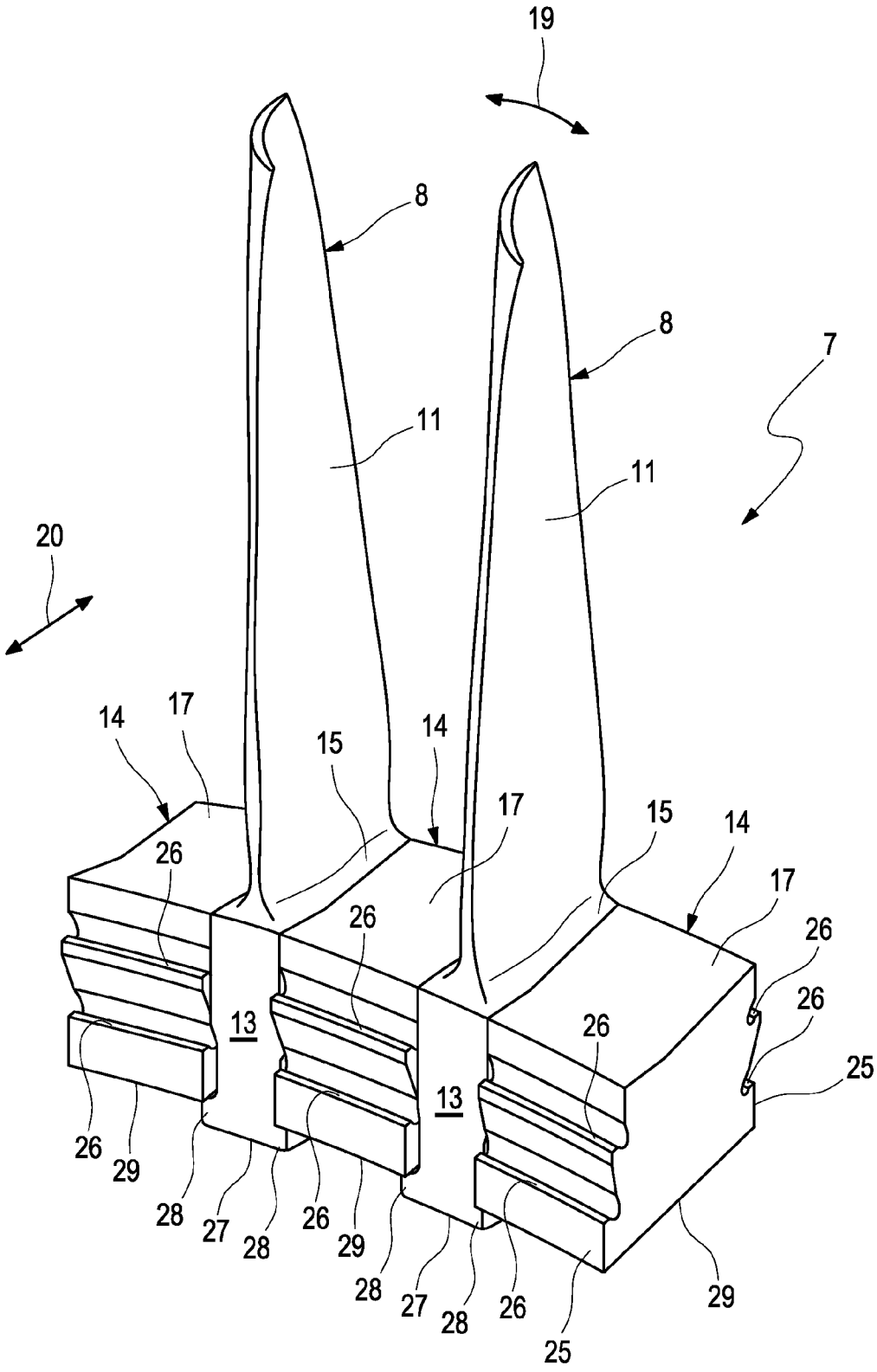
FIG. 2 shows an isometric view of a circumferential portion of a moving blade row of the rotor.

It is in this case especially advantageous if the end wall contours 16 of the outer faces 15 of the blade roots 13, on the one hand, and at the outer faces 17 of the intermediate pieces 14, on the other hand, are identically shaped geometrically. In particular, the flush transitions on the mutually adjacent outer faces 15, 17 of the blade roots 13 and of the intermediate pieces 14 can thereby be implemented. For example, the outer faces 15 of the blade roots 13 and the outer faces 17 of the intermediate pieces 14 may be adjacent to one another flush radially in the circumferential direction, as can be seen in FIG. 2.

An embodiment is especially expedient in which the end wall contours 16 of the outer faces 15 with the blade roots 13 and the end wall contours 16 of the outer faces 17 of the intermediate pieces 14 have an axially symmetrical configuration. This means that the end wall contours 16 have a profile which remains constant in the circumferential direction. The respective profile arises in this case as a result of a longitudinal section which contains the axis of rotation 6, as in FIGS. 1 and 5. The end wall contours 16 thus have a rotationally symmetrical configuration with respect to this axis of rotation 6. A three-dimensional transition from the blade root 13 to the blade leaf 11 may be expedient solely on the respective moving blade 8.

Figure 3:
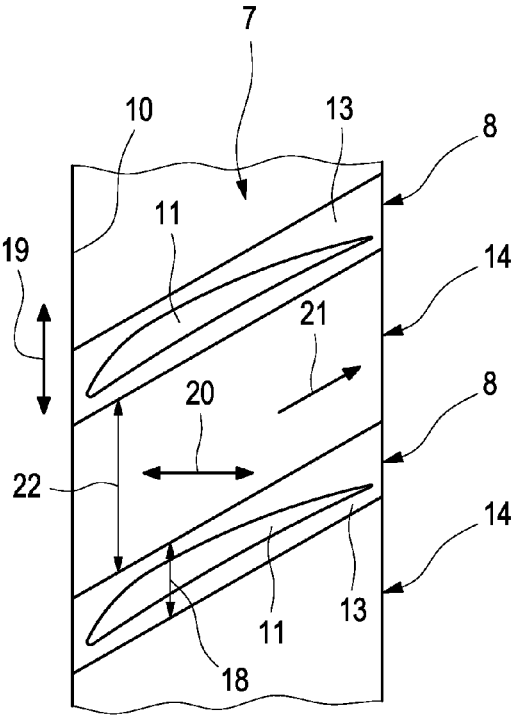
FIG. 3 shows a radial top view of a circumferential portion of the moving blade row.

In the embodiments shown in FIG. 3, the blade roots 13 and the intermediate pieces 14 are configured symmetrically, so that it is basically possible to arrange the blade roots 13 and intermediate pieces 14 in the reception slot 10 so as to be rotated through 180°. Rotation through 180° in this case refers to a rotation about the radial direction which stands perpendicularly to the drawing plane in FIGS. 3 and 4.

Figure 4:
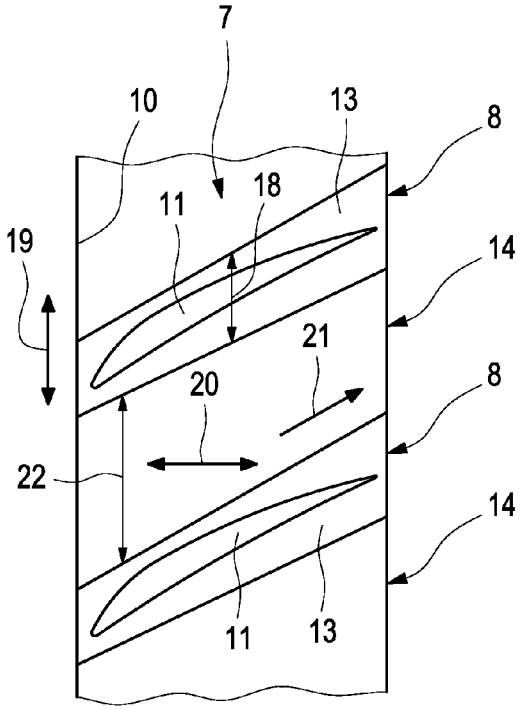
FIG. 4 shows a top view, as in FIG. 3, but in another embodiment.

In so far as the end wall contours 16 are configured asymmetrically with respect to the axial direction, as indicated in FIGS. 1 and 5, a reversed mounting of the intermediate pieces 14 leads to a significant deterioration in the flow around the blade leaves 11 in the region of the blade roots 13. Incorrect mounting of the moving blade 8 is in this case virtually ruled out, since this is immediately obvious because of the asymmetry of the blade leaves 11. To avoid an incorrect mounting of the intermediate pieces 14, there may be provision, according to FIG. 4, for configuring the intermediate pieces 14 and blade roots 13 asymmetrically in such a way that the intermediate pieces 14 can be properly mounted in only a single stipulated mounting position. In the example of FIG. 4, this is achieved, purely by way of example, by means of a wedge shape of the intermediate pieces 14 with respect to their axial extent and by means of a complementary wedge shape of the blade roots 13 likewise with regard to the axial extent. For example, a width 18 of the blade roots 13, which is measured in the circumferential direction 19 indicated in FIGS. 3 and 4 by a double arrow, can increase in the axial direction 20 indicated in FIGS. 3 and 4 and in FIG. 1 by a double arrow, in the direction of flow 21 of the working gas, as indicated in FIGS. 3 and 4 by a direction arrow, whereas a width 22, measured in the circumferential direction 19, of the intermediate pieces 14 decreases correspondingly in the axial direction 20 in the direction of flow 21. In contrast to this, in FIG. 3 the blade roots 13 possess a width 18 which remains constant in the direction of flow 21. The intermediate pieces 14 likewise possess here a width 22 which remains constant in the direction of flow 21.

As a result of the asymmetric shaping of the intermediate pieces 14 and of the blade roots 13, in the case of faulty mounting a visible gap between the blade root 13 and intermediate piece 14 would necessarily remain, so that incorrect mounting can be noticed immediately.

According to FIG. 1, the reception slot 10 has radially inward-directed supporting contours 24 on its slot walls 23 lying axially opposite one another. According to FIG. 2, the intermediate pieces 14 possess, at ends 25 facing away from one another in the axial direction 20, radially outward-directed supporting contours 26 which are shaped complementarily to the supporting contours 24 of the reception slot 10. In the mounted state, the supporting contours 26 of the intermediate pieces 14 can be supported radially on the supporting contours 24 of the reception slot 10. According to FIG. 2, the blade roots 13 have on their inner face 27, which faces away from the gas path 12 or from the outer face 15 of the blade root 13, shoulders 28 projecting in the circumferential direction 19. In this case, expediently two such shoulders 28 are provided for each blade root 13 and project on two end faces facing away from one another from the respective end face in the circumferential direction 19. In the mounted state, these shoulders 28 in each case engage under an inner face 29 of the adjacent intermediate piece 14, said inner face facing away from the outer face 17 of the intermediate piece 14 or from the gas path 12. Furthermore, in the mounted state, said shoulders 28 are supported radially on the inner faces 29 of the adjacent intermediate pieces 14. An embodiment is in this case especially advantageous in which the moving blades 8 are anchored radially to the rotor shaft 9 solely indirectly via the intermediate pieces 14.

According to FIG. 5, the end wall contour 16 may be configured such that it has exactly two turning points 30, with the result that it is possible to form a concave curvature 31 oriented toward the axis of rotation 6 and to implement tangential transitions at the end portions 32 of the end wall contour 16. The curvature 31, as can be seen, is arranged so as to be offset in relation to the axial direction 20 with respect to a geometric center 33 of the end wall contour 16, that is to say is arranged eccentrically. In particular, the curvature 31 is in this case positioned so as to be displaced toward the inflow side with respect to the center 33.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

1 Turbomachine
2 Compressor
3 Turbine
4 Stator
5 Rotor
6 Axis of rotation
7 Moving blade row
8 Moving blade
9 Rotor shaft
10 Reception slot
11 Blade leaf
12 Gas path
13 Blade root
14 Intermediate piece
15 Outer face of 13
16 End wall contour
17 Outer face of 14
18 Width of 13
19 Circumferential direction
20 Axial direction
21 Direction of flow
22 Width of 14
23 Slot wall
24 Supporting structure of 10
25 End of 14
26 Supporting structure of 14
27 Inner face of 13
28 Shoulder
29 Inner face of 14
30 Turning point
31 Curvature
32 End portion
33 Center

What is claimed is:

1. A rotor for a turbomachine, the rotor comprising:

at least one moving blade row including a plurality of moving blades disposed adjacent to one another in a circumferential direction with respect to an axis of rotation, each one of the plurality of moving blades including a blade leaf and a blade root having an outer face, the outer face of the blade root including a blade root curved end wall contour adjacent the blade leaf in the circumferential direction, the blade root curved end wall contour having a concave curvature in an axial sectional plane of the rotor;

at least one rotor shaft including a reception slot for a respective one of the at least one moving blade row extending in the circumferential direction, each of the plurality of moving blades being inserted into the reception slot via a respective blade root; and a plurality of intermediate pieces each disposed in the reception slot between two adjacent ones of the plurality of moving blades, each of the plurality of intermediate pieces including an outer face having an intermediate piece curved end wall contour, the intermediate piece curved end wall contour having a concave curvature in an axial sectional plane of the rotor, wherein the outer faces of the blade roots and the intermediate pieces are adjacent to one another flush radially in the circumferential direction, wherein each of the plurality of moving blades are fastened radially to the rotor shaft solely via the intermediate pieces.

2. The rotor as recited in claim 1, wherein each of the blade root and the intermediate piece end wall contours have two turning points.

3. The rotor as recited in claim 1, wherein the concave curvatures of the blade root and the intermediate piece end wall contours are disposed such that each curvature is displaced toward one of an inflow side and an outflow side.

4. The rotor as recited in claim 1, wherein the blade root and the intermediate piece end wall contours each have an axially symmetrical configuration.

5. The rotor as recited in claim 1, wherein the blade root and the intermediate piece end wall contours are identical.

6. The rotor as recited in claim 1, wherein each of the plurality of intermediate pieces and the blade roots are asymmetric such that each of the plurality of intermediate pieces are properly mountable in only one mounting position.

7. The rotor as recited in claim 1, wherein the reception slot includes radially inward-directed supporting contours disposed on slot walls of the reception slot, each of the plurality of intermediate pieces having radially outward-directed supporting contours complementary to the radially inward-directed supporting contours of the slot and being supported radially on the radially inward-directed supporting contours of the slot in a mounted state.

8. The rotor as recited in claim 7, wherein each of the blade roots include a shoulder disposed on an inner face of the blade root, the shoulder projecting in the circumferential direction and supported radially on an inner face of a respective adjacent intermediate piece in a mounted state.

9. The rotor as recited in claim 8, each of the plurality of moving blades are fastened radially to the rotorshaft indirectly via the intermediate pieces.

10. A compressor or a turbine for a turbomachine comprising a rotor as recited in claim 1.

11. A method for modernizing a rotor of a turbomachine, the rotor including at least one moving blade row having a plurality of moving blades disposed adjacently to one another in a circumferential direction with respect to an axis of rotation of the rotor, each one of the plurality of moving blades including a blade root, at least one rotor shaft including a reception slot for a respective one of the at least one moving blade row extending in the circumferential direction, each of the plurality of moving blades being inserted into the reception slot via the blade root of each of the plurality of moving blades, and a plurality of intermediate pieces each disposed in the reception slot between two adjacent ones of the plurality of moving blades, the method comprising:

exchanging the plurality of moving blades for a plurality of further moving blades each having a blade leaf and a curved end wall contour on a blade root outer face adjacent the blade leaf in the circumferential direction; and exchanging the plurality of intermediate pieces for a plurality of further intermediate pieces, each including an outer face including a curved end wall contour, wherein each of the plurality of moving blades are fastened radially to the rotor shaft solely via the intermediate pieces.

* * * * *